US010154345B2

(12) United States Patent
Faller et al.

(10) Patent No.: US 10,154,345 B2
(45) Date of Patent: Dec. 11, 2018

(54) SURROUND SOUND RECORDING FOR MOBILE DEVICES

(71) Applicant: Huawei Technologies Co., Ltd., Shenzhen (CN)

(72) Inventors: Christof Faller, Uster (CH); Alexis Favrot, Uster (CH); Peter Grosche, Munich (DE); Yue Lang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/626,962

(22) Filed: Jun. 19, 2017

(65) Prior Publication Data

US 2017/0289686 A1 Oct. 5, 2017

Related U.S. Application Data

(63) Continuation of application No. PCT/EP2014/078558, filed on Dec. 18, 2014.

(51) Int. Cl.

| | |
|---|---|
| ***H04R 3/00*** | (2006.01) |
| ***H04R 5/027*** | (2006.01) |
| ***H04R 1/40*** | (2006.01) |
| ***H04S 3/00*** | (2006.01) |
| ***H04R 5/04*** | (2006.01) |
| *H04R 1/32* | (2006.01) |

(52) U.S. Cl.

CPC ..... *H04R 5/027* (2013.01); *H04R 1/406* (2013.01); *H04R 3/005* (2013.01); *H04R 5/04* (2013.01); *H04S 3/00* (2013.01); *H04R 1/326* (2013.01); *H04R 2430/21* (2013.01); *H04R 2499/11* (2013.01); *H04S 2400/15* (2013.01)

(58) Field of Classification Search

CPC .... H04R 2499/11; H04R 1/406; H04R 3/005; H04R 2430/25; H04R 29/004; H04R 9/08; G10L 19/008

USPC ..... 381/17–19, 22–23, 307, 92, 122

See application file for complete search history.

(56) References Cited

U.S. PATENT DOCUMENTS

2008/0170728 A1 7/2008 Faller
2013/0315402 A1* 11/2013 Visser ..... G10L 19/00 381/18

FOREIGN PATENT DOCUMENTS

WO 2014012583 A1 1/2014
WO 2014167165 A1 10/2014

OTHER PUBLICATIONS

Faller, C., "Conversion of Two Closely Spaced Omnidirectional Microphone Signals to an XY Stereo Signal," XP040567158, Audio Engineering Society, Convention Paper 8188, Nov. 4-7, 2010, 10 pages.

(Continued)

*Primary Examiner* — George C Monikang
(74) *Attorney, Agent, or Firm* — Coley Rose, P.C.

(57) ABSTRACT

A microphone arrangement and a method using the microphone arrangement for recording surround sound in a mobile device, where the microphone arrangement comprises a first and a second microphone and arranged at a first distance to each other and configured to obtain a stereo signal, and comprises a third microphone configured to obtain a steering signal together with at least one of the first and second microphone or with a fourth microphone. The microphone arrangement also comprises a processor configured to separate the stereo signal into a front stereo signal and a back stereo signal based on the steering signal.

13 Claims, 9 Drawing Sheets

(56) References Cited

OTHER PUBLICATIONS

Tournery, C., et al., "Converting Stereo Microphone Signals Directly to MPEG-Surround," XP040509365, Audio Engineering Society, May 25, 2010, 3 pages.
Chen, R., et al., "A triple microphone array for surround sound recording," XP055204163, Abstract, Nov. 19, 2014, 7 pages.
Cook, R., et al., "Measurement of Correlation Coefficients in Reverberant Sound Fields," Journal of the Acoustical Society of America, 27(6), 1955, pp. 1072-1077.
"Microphones," Chapter 4, 2012, pp. 17-42.
Farrar, K., "Design and development of microphone and control unit," Wireless World, Oct. 1979, pp. 48-50.
Buck, M., et al., "First Order Differential Microphones Arrays for Automotive Applications," XP002680279, Sep. 10, 2001, 4 pages.
"Microphone Array Beamforming," XP055203987, Application Note, AN-1140, Dec. 31, 2013, 12 pages.
Foreign Communication From a Counterpart Application, PCT Application No. PCT/EP2014/078558, International Search Report dated Aug. 14, 2015, 6 pages.
Foreign Communication From a Counterpart Application, PCT Application No. PCT/EP2014/078558, Written Opinion dated Aug. 14, 2015, 13 pages.

* cited by examiner

SURROUND SOUND RECORDING FOR MOBILE DEVICES

CROSS-REFERENCE TO RELATED APPLICATION

This application is a continuation of International Patent Application No. PCT/EP2014/078558 filed on Dec. 18, 2014, which is hereby incorporated by reference in its entirety.

TECHNICAL FIELD

The present disclosure is directed to a microphone arrangement for, and a method of surround sound recording in a mobile device. In particular, the present disclosure enables multi-channel recording, i.e. enables a recording of two or more, for example five or more channels, in the mobile device.

BACKGROUND

Typically, mobile devices offer the possibility to record video and audio data. For a spatially extended audio experience, some mobile devices even allow the audio data to be natively recorded as surround sound using multiple microphones and substantial post-processing of the microphone signals. Conventional mobile devices like smart phones and tablets, however, do not provide the capability to record such multi-channel surround sound, because for conventional surround sound recording techniques, large and expensive microphone arrays or setups are required.

For example, augmented DECCA Tree, Optimized Cardioid Triangle (OCT) and XYtri configuration are known as a setup for surround sound recording. Because of their size, these setups are not applicable for mobile devices.

More compact conventional microphone setups also known for surround sound recording are, for example, the "Soundfield microphone" (as described by K. Farrar, "Soundfield microphone: Design and development of microphone and control unit", Wireless World, pages 48-50, October 1979) and the "Schoeps Double MS" (as described under http://www.schoeps.de/en/products/categories/dms). However, both setups require the use of specific pressure gradient microphone elements, which are not suited for rather small mobile devices like tablets, smartphones or the like.

Some approaches in the other approaches use omnidirectional microphones for recording sound, where the advantage is that cheap microphones can be used. For instance, a pair of omnidirectional microphone signals can be converted to two first-order differential signals to generate a stereo signal with improved left-right separation (as described, for instance, by C. Faller, "Conversion of two closely spaced omnidirectional microphone signals to an xy stereo signal", Preprint 129th Conv. Aud. Eng. Soc., November 2010). However, a weakness is that the differential signals have a low signal-to-noise ratio (SNR) at low frequencies, and have spectral defects at higher frequencies. This effect strongly depends on the distance between the microphones. At small distances, also low frequencies are affected. The distance between the microphones for recording front/back signals is limited by the thickness of the device when recording sound using a mobile device such as a tablet. As modern devices are typically less than one centimeter thick, the maximum distance between the microphones is small. In this case a front/back separation is not sufficiently resolved, and consequently no surround recording is possible for small setups. That is, for these approaches still a large spacing between the microphones is needed.

Some other approaches use directional microphones (e.g., cardioid) for surround sound recording. The advantage is that the microphones can be placed close to each other (co-incident). However, more complex and expensive directional microphones are required.

Generally, it is technically difficult due to the small form factors of mobile devices to arrange microphones that capture good surround sound, because the recording of surround sound requires a number of microphones with specific placements and directional responses. Additionally, surround sound recording typically requires expensive directive microphones. Such directive microphones are also required to be mounted in free air, but on mobile devices only one sided openings are possible, which limits the use of sound pressure (i.e. omnidirectional) microphones.

As a result of the above, in the existing market only a few mobile devices, namely high-end dedicated video cameras, which are typically big and expensive, feature surround sound recording. Smaller mobile devices, like smart phones and tablets, usually feature only mono or limited stereo sound capture. There is a need for suitable small and cost-effective microphone setups, for example for portable devices like tablets or smartphones.

SUMMARY

Accordingly, in view of the disadvantages of the other approaches, the present disclosure aims to improve the other approaches. In particular, the object of the present disclosure is to provide a microphone setup for recording surround sound in a mobile device, which is sufficiently small and cost-effective. That is, space and cost restrictions of mobile devices like, smart phones and tablets, need to be satisfied.

The above-mentioned object of the present disclosure is achieved by the solution provided in the enclosed independent claims. Advantageous implementations of the present disclosure are further defined in the respective dependent claims. In particular, the present disclosure proposes a way of combining advantageously at least three microphones on a mobile device, wherein at least one pair of these at least three microphones is used for stereo signal (i.e. left/right) recording (this pair is referred to as the "LR pair"). An at least a second pair of these at least three microphones is used for obtaining a front/back steering signal (this pair is referred to as the "FB pair").

Further, a first aspect of the present disclosure provides a microphone arrangement for recording surround sound in a mobile device. The microphone arrangement comprises a first and a second microphone wherein the first microphone is arranged to obtain a first audio signal of a stereo signal and the second microphone is arranged to obtain a second audio signal of the stereo signal. Furthermore, the microphone arrangement comprises a third microphone configured to obtain a third audio signal. The microphone arrangement also comprises a processor configured to obtain a steering signal based on the third audio signal and another audio signal obtained by another microphone of the microphone arrangement and to separate the stereo signal into a front stereo signal and a back stereo signal based on the steering signal. Thereby, the front stereo signal as well as the back stereo signal comprises a left audio channel and a right audio channel.

As mentioned above, the stereo signal includes left/right information. The first and second microphones are thus the LR pair. The FB pair is composed of the third microphone and either one or both of the first and second microphones.

Advantageously, the surround sound is generated using a parametric approach. The stereo signal is preferably recorded with high-grade microphones (omnidirectional or directive), in order to generate the output channels, whereas the steering signal is preferably obtained from possibly low-grade microphones (omnidirectional or directive) in order to only derive a steering parameter from the steering signal by employing some kind of direction of arrival estimation. In other words, only the LR pair can actually be used for recording sound, the FB pair can be only used for obtaining the steering signal. Based on the steering signal (for example using the derived steering parameter) the LR stereo signal is separated into the front stereo signal (i.e. front LR) and the back stereo signal (i.e. back LR).

The steering signal provides front and back information based on the third audio signal and at least one of the other audio signals. The steering signal can be in particular a binary front-back signal. Furthermore, it can be a continuous function based on the respective audio signals. The steering signal can control the ratio of the stereo signal put into the front and the back stereo signals.

The advantage of the microphone arrangement of the first aspect is that surround sound information can be detected with a minimal number of microphones, and that the microphone arrangement is particularly suited to be built into a mobile device like a smart phone, a tablet or a digital camera.

In a first implementation form of the microphone arrangement according to the first aspect, the microphone arrangement comprises a fourth microphone arranged to obtain a fourth audio signal. In this case, the processor is configured to obtain a steering signal based on the third audio signal and at least one of the first audio signal the second audio signal, and the fourth audio signal.

The third microphone can be arranged with a pre-defined perpendicular distance to the intersection of the first and second microphones. In particular, the third microphone can be arranged on a surface of a tablet, smartphone or similar device. The fourth microphone can be arranged at another perpendicular distance to the intersection of the first and the second microphone. In particular, the fourth microphone can be arranged at the surface of a tablet, smartphone or similar device which is opposite of the surface that carries the third microphone.

Advantageously different microphones can be used for obtaining the stereo signal and the steering signal. In particular, the stereo signal can be obtained by the first and the second microphone and the front and back information can be obtained by the third and fourth microphone.

In a second implementation form according to the first aspect as such or according to the first implementation form of the first aspect the steering signal comprises direction-of-arrival (DOA), information and the processor is configured to combine the DOA information with at least a part of the stereo signal to obtain the front and back stereo signals.

The combination can comprise in particular mathematical operations like multiplication, summation, and/or fusion algorithms such as Kalman filters, etc. Furthermore, depending on the steering signal, the DOA information can be more precise or less precise. In particular, if the steering signal is a binary signal indicating only audio information from the front and audio information from the back, the DOA information also contains only a distinction between audio-signals from the front and audio signals from the back.

The FB pair microphones configured to obtain the steering signal can be closely arranged microphones, i.e. can be arranged within the thickness of a typical mobile device. These microphones configured to determine the steering signal yield only little spatial information, but can be used to resolve the direction, from where the sound recorded by the LR pair microphones originates. Thus, the necessary parameter for separating the stereo signal into the front and back stereo signals can be obtained.

In a third implementation form of the microphone arrangement according to the second implementation form of the first aspect, the processor is configured to determine a direct-sound component and a diffuse-sound component of the stereo signal, and to combine the DOA information only with the direct-sound component of the stereo signal to obtain the front and back stereo signals.

The direct-sound component of the stereo signal originates from a directional sound source, which can be located, whereas the diffuse-sound component originates from sources that cannot be located. Thus, only the direct-sound component is combined with the DOA information, in order to obtain an overall better surround sound quality.

In a fourth implementation form of the microphone arrangement according to the second or third implementation form of the first aspect, the processor is configured to determine the DOA information based on a first inter-channel-level-difference (ICLD), between the third audio signal and the other audio signal, wherein the first ICLD bases on a difference between time and/or frequency representations, in particular power spectra, of the first audio signal and the other audio signal.

By calculating the first ICLD, the processor can obtain DOA information particularly well for low frequencies of the recorded sound.

In a fifth implementation form of the microphone arrangement according to the fourth implementation form of the first aspect, the third microphone and the other microphone, in particular the microphones used for the steering signal, are omnidirectional sound pressure microphones, and the processor is configured to process the third audio signal and the other audio signal such that two virtual sound pressure gradient microphones directed to opposite directions are formed, and to obtain the first ICLD on the basis of the output signals of the two virtual sound pressure gradient microphones.

Based on two omnidirectional sound pressure microphones, in particular by delaying one of the signals obtained by the two microphones and subtracting it from the signal obtained by the other, two virtual directional microphones can be created, i.e. one pointing to the front and one pointing to the back of the microphone arrangement. Thus, an optimized steering signal for separating the stereo signal into the front and back stereo signals is obtained.

In a sixth implementation form of the microphone arrangement according to one of the second to sixth implementation form of the first aspect, the processor is configured to determine the DOA information based on a second ICLD of the microphones configured to obtain the steering signal, wherein the second ICLD bases on a difference between time- and/or frequency-representations, in particular power spectra, between respective input signals of said microphones, the gain difference being caused by a shadowing effect of a housing of the microphone arrangement disposed at least partly between said microphones.

Using the second ICLD, the processor can determine the DOA information with a lower SNR for high frequencies of the sound which are in particular affected by spectral defects in the delay-and-subtract processing.

In a seventh implementation form of the microphone arrangement according to one of the fourth to fifth implementation form of the first aspect and according to the sixth implementation form of the first aspect, the processor is configured to use the first ICLD to determine the DOA information for frequencies of the stereo signal at or below a determined threshold value, and use the second ICLD to determine the DOA information for frequencies of the stereo signal above the determined threshold value.

The advantage of the frequency dependent ICLD use is that an optimal processing is selected for every frequency of the sound, and thus overall the best surround sound signal can be recorded. The second ICLD caused by the shadowing effect of the microphone arrangement (or mobile device) is in particular effective for frequencies of sound above 10 kilohertz (kHz), preferably for frequencies $f>c/(4d_2)$, where c denotes the celerity of the recorded sound and $d_2$ is the distance between the microphones configured to obtain the steering signal. This distance is typically related to the thickness of the mobile device, since the microphones configured to obtain the steering signal are preferably provided on the front side and the back side of the mobile device, respectively.

The third microphone can be configured to obtain the steering signal together with one of the first and second microphone, and a second distance between the third microphone and the one of the first and second microphone is perpendicular to the first distance between the first and the second microphone, or the third microphone can be configured to obtain the steering signal together with the fourth microphone, and the fourth microphone is arranged at a second distance to the third microphone perpendicular to the first distance between the first and the second microphone.

The advantage of the perpendicular second distance in case of no fourth microphone, i.e. when detection is performed with at least one of the first and second microphone, is that there is no (or reduced) coupling between the stereo signal and the steering signal. The advantage of the perpendicular second distance in case of a fourth microphone for obtaining the steering signal is that there is no (or reduced) coupling between the stereo signal of the LR pair, and the steering signal of the FB pair.

In an eighth implementation form of the microphone arrangement according to the seventh implementation form of the first aspect, the determined threshold value depends on a second distance between the third microphone and one of the first, second, and the fourth microphone.

In a ninth implementation form of the microphone arrangement according to the fourth to eighth implementation form of the first aspect, the processor is configured to bias the first ICLD and or the second ILCD towards the third microphone or the other microphone.

The biasing of the first and/or the second ICLD has the advantage of an improvement of the SNR, particularly in case of only small signal differences. Preferably, a bias-parameter used for the biasing follows a tangent function, whereas the function is preferably such that it only amplifies great values and leaves small values near zero.

In a tenth implementation form of the microphone arrangement according to one of the second to ninth implementation form of the first aspect, the processor is configured to bias the DOA information towards one of the third microphone or the other microphone.

The biasing of the DOA information has the advantage that the surround effect of the recorded surround sound can be changed as desired.

In an eleventh implementation form of the microphone arrangement according to the first aspect as such or according to any previous implementation form of the first aspect, the third microphone and the other microphone are directional microphones and/or are directed to opposite directions, and/or the first and the second microphone are directional microphones and/or are directed towards the opposite directions.

The advantage of the opposite directions of the microphones is that there is no coupling within the signals (recorded respectively by the FB pair microphones) composing the steering signal, and the signals (recorded respectively by the LR pair microphones) composing the stereo signal, respectively.

In a twelfth implementation form of the microphone arrangement according to the first aspect as such or according to any previous implementation form of the first aspect, the processor is configured to determine a center signal from the stereo signal, or the fourth microphone is configured to obtain a center signal.

With the additional center signal, the recorded surround sound has five channels, and can for instance be a 5.1 standard surround sound signal.

A second aspect of the present disclosure provides a mobile device with a microphone arrangement according to the first aspect as such or according to any implementation form of the first aspect, wherein the first and the second microphone are arranged in an essentially horizontal user plane.

The mobile device of the second aspect is able to record surround sound, preferably with five channels. Due to the possible small setup of the microphone arrangement, also the mobile device can be built compact, in particular thin. The surround sound recording can nevertheless be realized with reasonably cheap microphones. In general the mobile device of the second aspect enjoys all the advantages mentioned above in relation to the various implementation forms of the first aspect.

A third aspect of the present disclosure provides a method of surround sound recording in a mobile phone, comprising the steps of obtaining a first audio signal of a stereo signal with a first microphone and a second audio signal of a stereo signal with a second microphone, obtaining a third audio signal with a third microphone, obtaining a steering signal with a third microphone together with at least one of the first and second microphone and/or with a fourth microphone, and separating the stereo signal into a front stereo signal and a back stereo signal based on the steering signal.

In a first implementation form of the method according to the third aspect, a fourth audio signal is obtained by a fourth microphone, and a steering signal based on the third audio signal and at least one of the first audio signal, the second audio signal, and the fourth audio signal is obtained.

In a second implementation form of the method according to the third aspect as such or according the second implementation form of the third aspect, the steering signal comprises (DOA) information, and the DOA information is combined with at least a part of the stereo signal to obtain the front and back stereo signals.

In a third implementation form of the method according to the second implementation form of the third aspect, a direct-sound component and a diffuse-sound component of the stereo signal is determined, and the DOA information is combined only with the direct-sound component of the stereo signal to obtain the front stereo signal and the back stereo signal.

In a fourth implementation form of the method according to one of the second or third implementation form of the second aspect, the DOA information is determined based on a third ICLD, between the third audio signal and the other audio signal, wherein the first ICLD is based on a difference between time- and/or frequency-representations, in particular power spectra, of the first audio signal and the other audio signal.

In a fifth implementation form of the method according the fourth implementation form of the third aspect, audio signals are obtained from omnidirectional sound pressure microphones, and the third audio signal and the other audio signal are processed such that two virtual sound pressure gradient microphones directed to opposite directions are formed, and the first ICLD is obtained on the basis of the output signals of the two virtual sound pressure gradient microphones.

In a sixth implementation form of the method according to one of the second to the fifth implementation form of the third aspect the DOA information is determined additionally based on a second ICLD between the third audio signal and the other audio signal, wherein the second ICLD bases on a difference between time- and/or frequency-representations, in particular power spectra, between the third audio signal and the other audio signal, the difference being caused by a shadowing effect of a housing of the microphone arrangement disposed at least partly between the third microphone and the other microphone.

In a seventh implementation form of the method according to one of the fourth to fifth implementation form and according to seventh implementation form of the third aspect, the first ICLD is used to determine the DOA information for frequencies of the stereo signal at or below a determined frequency threshold value, and the second ICLD is used to determine the DOA information for frequencies of the stereo signal above the determined frequency threshold value.

In an eighth implementation form of the method according to the seventh implementation form of the third aspect, wherein the determined threshold value depends on a second distance between the third microphone and one of the first, second, and the fourth microphone.

In a ninth implementation form of the method according to fourth to eighth implementation form or the sixth implementation form of the third aspect, the first and/or the second ICLD is biased towards the third microphone or the other microphone.

In a tenth implementation form of the method according to one of the third implementation form to the ninth implementation form of the third aspect, the DOA information is biased towards one of the third microphone or the other microphone.

In an eleventh implementation form of the method according the third aspect or any implementation form of the second aspect a center signal is determined from the stereo signal, or from a fourth microphone.

The third aspect as such and the various implementation forms of the third aspect achieve the same advantages as the first aspect as such and the various implementation forms of the first aspect, respectively.

A fourth aspect of the present disclosure provides a computer program comprising a program code for performing, when running on a computer, the method according to the third aspect as such or according to any implementation form of the third aspect.

The computer program of the fourth aspect has all the advantages of the method of the third aspect.

It has to be noted that all devices, elements, units and means described in the present application could be implemented in the software or hardware elements or any kind of combination thereof. All steps which are performed by the various entities described in the present application as well as the functionalities described to be performed by the various entities are intended to mean that the respective entity is adapted to or configured to perform the respective steps and functionalities. Even if, in the following description of specific embodiments, a specific functionality or step to be full formed by eternal entities not reflected in the description of a specific detailed element of that entity which performs that specific step or functionality, it should be clear for a skilled person that these methods and functionalities can be implemented in respective software or hardware elements, or any kind of combination thereof.

BRIEF DESCRIPTION OF DRAWINGS

The above-described aspects and implementation forms of the present disclosure will be explained in the following description of specific embodiments in relation to the enclosed drawings.

DETAILED DESCRIPTION OF EMBODIMENTS

Generally, the microphone arrangement of the present disclosure requires at least two pairs of microphone, namely one pair (the LR pair) to record left/right stereo information (the stereo signal), and one pair (the FB pair) to record a signal for obtaining a front/back separation parameter (the steering signal). The two pairs of microphones may be composed of at least three microphones. In the case of three microphones, a first and a second microphone form the LR pair, and a third microphone forms together with the first and/or the second microphone the FB pair. Preferably, at least four microphones are used, wherein a first microphone and a second microphone form the LR pair, and a third microphone and a fourth microphone form the FB pair.

The two microphones used as the FB pair are preferably placed such that one points towards the front and one points towards the back of a mobile device, in order to benefit from a shadowing effect caused by the housing of the mobile device for a better front/back discrimination. The FB pair microphones can be of low grade, since they are only relevant for information extraction for the steering signal, and not directly generate audio signals for the sound recording. The two microphones used as the LR pair are preferably placed on the sides (left and right) of the mobile device, and preferably point towards the same direction (to avoid shadowing effects), e.g. to the back of the mobile device, however they could also point to the front. For mobile devices having large enough form factors, the LR pair microphones are thus already ideally suited to capture a relevant stereo image. The LR pair microphones are preferably of higher grade, since they are relevant for generating high-quality audio signals for the sound recording.

Figure 1:
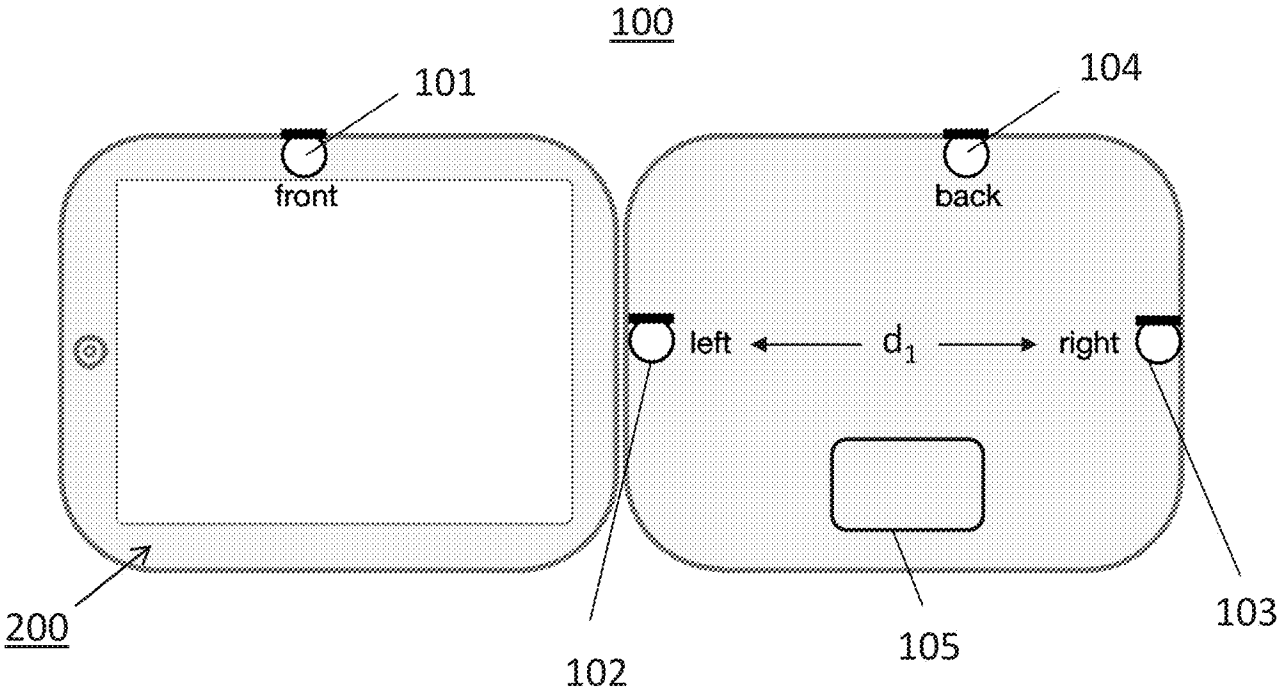
FIG. 1 shows an example of a microphone arrangement according to an embodiment of the present disclosure with four microphones mounted on a mobile device.

FIG. 1 shows a microphone arrangement 100 in a device according to an embodiment of the present disclosure, or a device, here a tablet or smartphone, comprising the microphone arrangement. The embodiment is a specific embodiment of the above described general microphone arrangement. The microphone arrangement 100 includes four microphones 101-104 (designated as m1-m4 in FIG. 2) and a processor 105, e.g. a processor 105. The microphones 101-104, m1-m4 can be mounted onto a mobile device 200 as illustrated in FIG. 1. The mobile device 200 can be a tablet, smart phone, mobile phone, laptop, camera, computer, or any other portable device with the capability to record sound. A first microphone 102 m2 and a second microphone 103 m3 are configured to obtain a stereo signal. In FIG. 1 these microphones 102 m2 and 103 m3, which form the LR pair, are placed, as is preferred, at the sides of the mobile device 200, and are separated by a first distance $d_1$ for capturing a relevant stereo image. A third microphone 101 m1 and a fourth microphone 104 m4 are configured to obtain a steering signal. In FIG. 1 these two microphones 101 m1 and 104 m4, which form the FB pair, are placed, as is preferred, in the center of the mobile device 200. Thereby, one microphone points towards the front of the mobile device 200, and the other microphone points towards the back of the mobile device 200, in order to enable a front/back discrimination based on the steering signal (DOA, 1-DOA).

As noted above, the fourth microphone 104 may be omitted, and instead the third microphone 101 may be configured to obtain the steering signal (DOA, 1-DOA) together with at least one of the first microphone 102 and the second microphone 103. In other words, the two necessary pairs of microphones (LB pair and FB pair) may be formed from just the three microphones 101-103, whereby at least one microphone of the LB pair microphones 102 and 103 is also used as microphone for the FB pair.

The microphone arrangement 100 further includes a processor 105, which is configured to separate the stereo signal obtained by the LR pair microphones 102 and 103 into a front stereo signal (FL, FR) and a back stereo signal based on the steering signal (DOA, 1-DOA) obtained by the FB pair microphones 101 and 104. In FIG. 1 the processor 105 is provided as a separate unit. In this case, the processor 105 is preferably integrated into the housing of the mobile device 200. The processor 105 could even be a processor of the mobile device 200. However, the processor 105 can also be part of one or more of the microphones 101-104. That is, for instance, the processor 105 may be configured to separate the stereo signal of the first and second microphones 102 and 103 into the front and back stereo signals, based on the audio signal obtained by the third microphone 101. Alternatively, the first and second microphones 102 and 103 may be provided, from at least the third microphone 101, with the steering signal (DOA, 1-DOA), and may use the steering signal (DOA, 1-DOA) together with the captured stereo signal, in order to output the front stereo signal (FL, FR) and back stereo signal (BL, BR), respectively.

At least the microphones configured to obtain the steering signal (DOA, 1-DOA), i.e. in FIG. 1 the third and fourth microphones 101 and 104, may be, in particular omnidirectional, sound pressure microphones, which are configured to measure a sound field's sound pressure at one point. In this case, when the wave length of the sound is large compared to a body size of the microphones, e.g. double the body size or larger, the measured sound pressure does not depend on a DOA information of the sound. That means a sound pressure microphone has an omnidirectional characteristic.

Advantageously, the microphones 101 and 104 are even two virtual sound pressure gradient microphones, which are directed to opposite directions. Such pressure gradient microphones aim at measuring the sound pressure gradient relative to a certain direction. In practice, the sound pressure gradient may be approximated by measuring the difference in sound pressure between two points (using two closely spaced omnidirectional microphones, like the microphones 101 and 104). Additionally, a delay may be applied to one obtained microphone signal, which is subtracted from the other obtained microphone signal, which relates to the directional response of an obtained difference signal. That is, the processor 105 is preferably configured to apply a delay-and-subtract processing resulting in two virtual sound pressure gradient microphones 101 and 104, which are directed to opposite directions.

Figure 2:
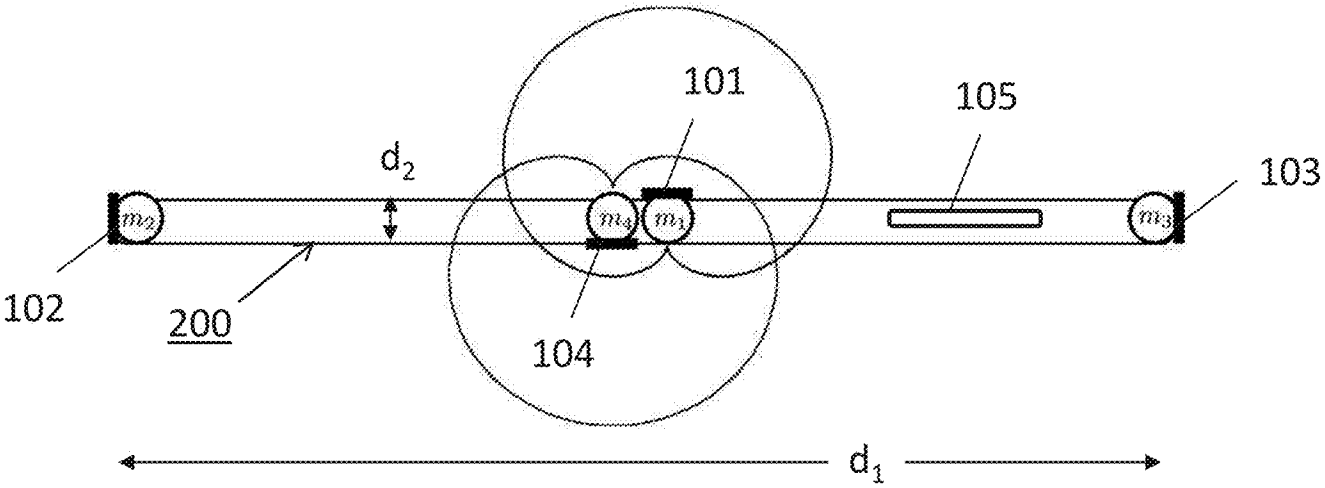
FIG. 2 shows a top view of the mobile device of FIG. 1, wherein two microphones for obtaining the steering signal are placed to benefit from a shadowing of the housing of the mobile device, and two microphones for recording the stereo signal are placed close to the sides of the mobile device.

The measurement of a sound pressure difference with a delay between two points (represented by the third and the fourth microphone 101 and 104) spaced apart by a second distance $d_2$ is illustrated in FIG. 2. Given the arrangement of the omnidirectional microphones 101 and 104, as illustrated in FIG. 2, two virtual cardioid signals, $x_f(t)$ and $x_b(t)$ in time domain, $X_f(k,i)$ and $X_b(k,i)$, in a suitable time-frequency domain such as the short-time Fourier transform (STFT) domain, wherein t is the time index, k is the spectrum time index and i is the frequency index, can be derived based on gradient processing (as described, for instance, by C. Faller, "Conversion of two closely spaced omnidirectional microphone signals to an xy stereo signal", Preprint 129th Conv. Aud. Eng. Soc., November 2010).

Figure 3:
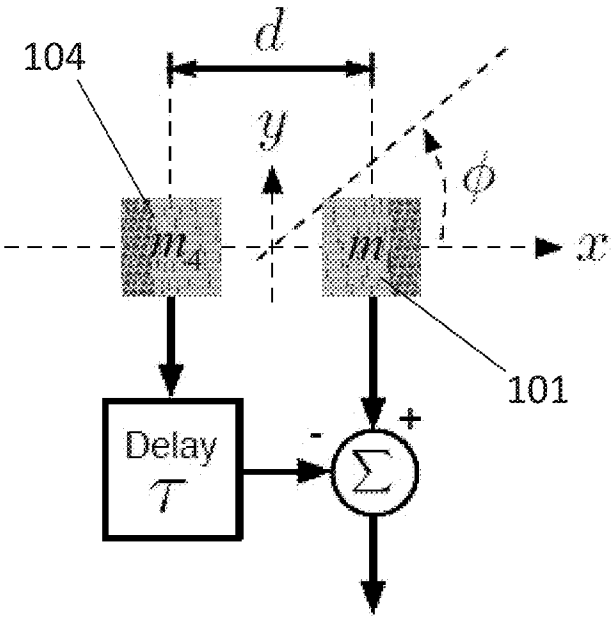
FIG. 3 shows an illustration of a delay-and-subtract operation applied to two omnidirectional microphone signals, in order to yield a first-order directive signal.

One way of converting the sound pressure signals of the two preferably omnidirectional microphones 101 and 104 into pressure gradient signals is to apply a delay-and-subtract processing in order to obtain a directional signal towards the front and back of the microphone arrangement 100, i.e. a positive and negative x-direction, respectively, as shown in FIG. 3.

Front and back pointing pressure gradient signals, $x_f(t)$ and $x_b$ (t), are computed as:

$$x_f(t)=h(t)*(m_1(t)-m_4(t-\tau))$$

$$x_b(t)=h(t)*(m_4(t)-m_1(t-\tau))$$

where, $m_1(t)$ and $m_4(t)$ denote the time-domain signals of the microphones 101 and 104, respectively, * denotes an optional linear convolution with h(t) being an impulse response of a free-field response correction filter. The delay r relates to the directional response of the virtual cardioid microphones and depends on the distance between the two microphones and the desired directivity:

$$\tau = \frac{ud}{c(1-u)},$$

where, d represents the distance between the microphones, and c the celerity of sound. In a preferred embodiment, this distance is very small and compatible with mobile device applications. It is then in the range 2 to 10 millimeters (mm).

The parameter u controls the directivity and can be defined as:

$$u = \frac{\cos\left(\frac{\pi}{2}+\phi\right)}{\cos\left(\frac{\pi}{2}+\phi\right)-1},$$

wherein $\phi$ can be a value between 0 and $\pi/2$.

Further, $x_f(t)$ and $x_b(t)$ are converted to a time/frequency representation $X_f(k,i)$ and $X_b(k,i)$, e.g., using STFT.

The front and back power spectra are respectively estimated as:

$$P_f(k,i)=E\{X_f(k,i)X_f(k,i)^*\}$$

$$P_b(k,i)=E\{X_b(k,i)X_b(k,i)^*\}. \quad (1)$$

In the above formula (1), E{ . . . } denotes short-time averaging (temporal smoothing), and * the conjugate complex.

In order to estimate the DOA information of the sound, the level difference between the front and back signals captured by the microphones 101 and 104, i.e. the two parts of the obtained steering signal (DOA, 1-DOA), can be used. This level difference is also denoted as a first inter-channel level difference (ICLD). In particular, the processor 105 is configured to determine the DOA information based on the first ICLD of the microphones 101 and 104, which are configured to obtain the steering signal (DOA, 1-DOA).

$$ICLD_1(k,i) = 20\log10\left(\frac{P_f(k,i)}{P_b(k,i)}\right). \quad (2)$$

This first ICLD measure in formula (2) is in particular limited and translated to the interval [−1, 1] for post-processing and for DOA information estimation:

$$icld_1(k,i) = \frac{\max\{g_{ICLD_1}, \min\{ICLD_1(k,i), g_{ICLD_1}\}\}}{g_{ICLD_1}}, \quad (3)$$

In the formula (3), $g_{ICLD}$ (in decibel (dB)) is a limiting gain.

The first ICLD bases generally on a difference between time/frequency representations, in particular power spectra, of the input signals obtained by the microphones 101 and 104. The processor 105 is preferably configured to determine the DOA information of the sound based on this first ICLD of the microphones 101 and 104, which are configured to obtain the steering signal (DOA, 1-DOA).

Because of the spacing distance $d_2$ between the two microphones 101 and 104, frequency aliasing will occur in the estimated pressure gradient signals for frequencies above the threshold value:

$$f_1 = \frac{c}{4d}, \quad (4)$$

In formula (4), c stands for celerity of sound and d (=$d_2$) is the distance between the microphones 101 and 104. This distance $d_2$ is typically related to the thickness of the mobile device 200, as shown in FIG. 2, which can be, for example 1 cm or even only 0.5 centimeters (cm). In this frequency region (usually corresponding to high frequencies above 10 kHz) the determination of the front/back separation, i.e. the DOA information, in the steering signal (DOA, 1-DOA) can take advantage of a shadowing effect caused by the housing of the mobile device 200, the housing being arranged between the two microphones 101 and 104. The shadowing effect leads to a gain difference between the omnidirectional input signals of the two microphones 101 and 104, $M_1(k,i)$ and $M_4(k,i)$, and a second ICLD may be derived:

$$ICLD_2(k,i) = 20\log10\left(\frac{M_1(k,i)}{M_4(k,i)}\right). \quad (5)$$

Again the ICLD measure (5) is translated to the interval [−1, 1] for post-processing and DOA information estimation:

$$icld_2(k,i) = \frac{\max\{g_{ICLD_2}, \min\{ICLD_2(k,i), g_{ICLD_2}\}\}}{g_{ICLD_2}}, \quad (6)$$

In the above formula (6), gICLD (in dB) is again a limiting gain. Additionally since the two omnidirectional power spectra $M_1$ and $M_4$ are potentially not matched and/or not calibrated to catch front/back gain difference in the steering signal (DOA, 1-DOA), the ICLD measurement of formula (5) may be biased towards one direction (front or back of the microphone arrangement 100). Thus, slight gain differences are not relevant, and in order to minimize the influence of small gain differences $icld_2$ may be post-processed using the following $$icld_2(k,i) = \frac{\tan(t_{icld_2} icld_2(k,i))}{\tan(t_{icld_2})}, \quad (7)$$

Figure 4:
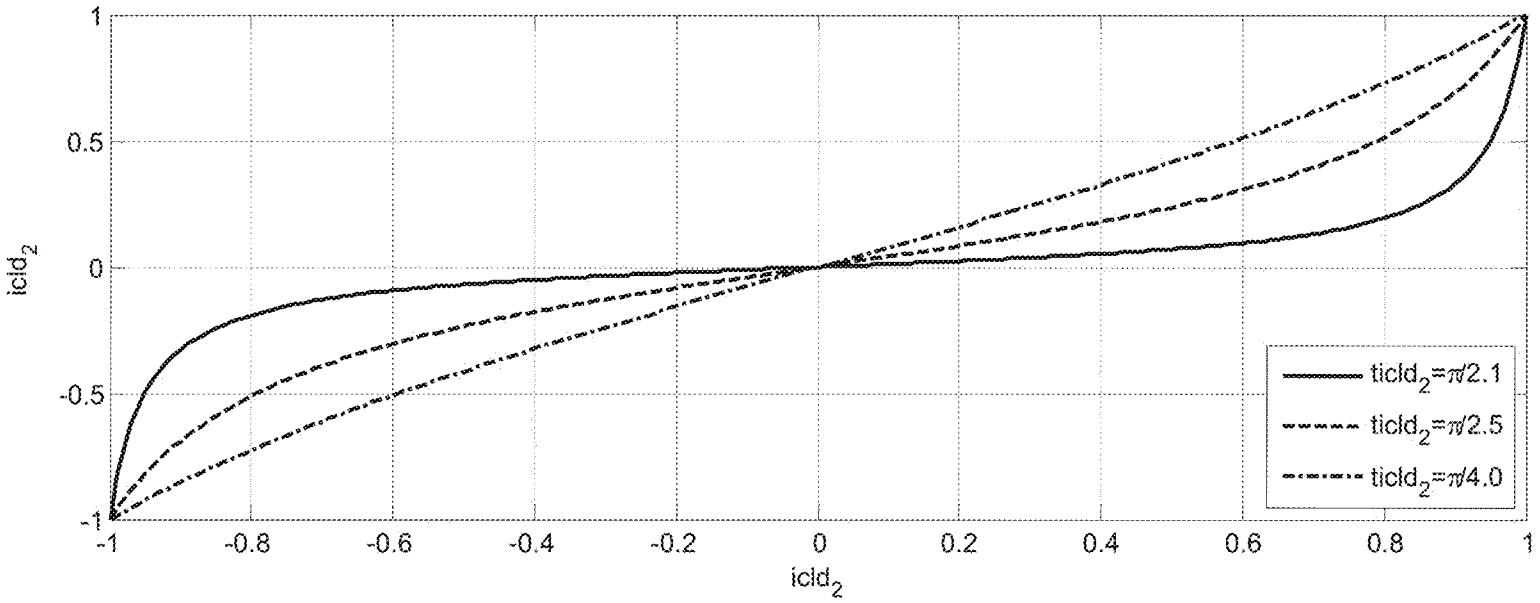
FIG. 4 shows a tangent function for post-processing of the first ICLD based on the two omnidirectional microphone input signals.

Therein, ticld is a parameter controlling the influence of small gain differences as shown in FIG. 4. A parameter ticld=$\pi/2$ will lead to a configuration, in which only large measured gain difference values between the microphones 101 and 104 will yield a non-zero $icld_2(k, i)$, whereas a smaller parameter ticld<$\pi/2$ will tend to a more linear function.

The second ICLD bases generally on a gain difference between respective input signals of said microphones 101 and 104, the gain difference being caused by the shadowing effect of the housing of the microphone arrangement 100 (or the mobile device 200) disposed at least partly between said microphones 101 and 104. The processor 105 is preferably configured to determine the DOA information of the sound based on this second ICLD of the microphones 101 and 104 configured to obtain the steering signal (DOA, 1-DOA).

A total ICLD over the full frequency range can then be derived as:

$$icld(k, i) = \begin{cases} icld_1(k, i) & i \le i_1 \\ icld_2(k, i) & \text{otherwise} \end{cases}, \tag{8}$$

In the formula (8), $i_1$ is the frequency index corresponding to the aliasing frequency fl as defined in the formula (4). The front-back separation represented by the DOA information may be derived by transforming the total ICLD in formula (8) into a value in the interval [0, 1] as:

$$doa(k, i) = \frac{1}{2} + \frac{1}{2}\frac{\arctan(t_{doa}\, icld(k, i))}{\arctan(t_{doa})} \tag{9}$$

Figure 5:
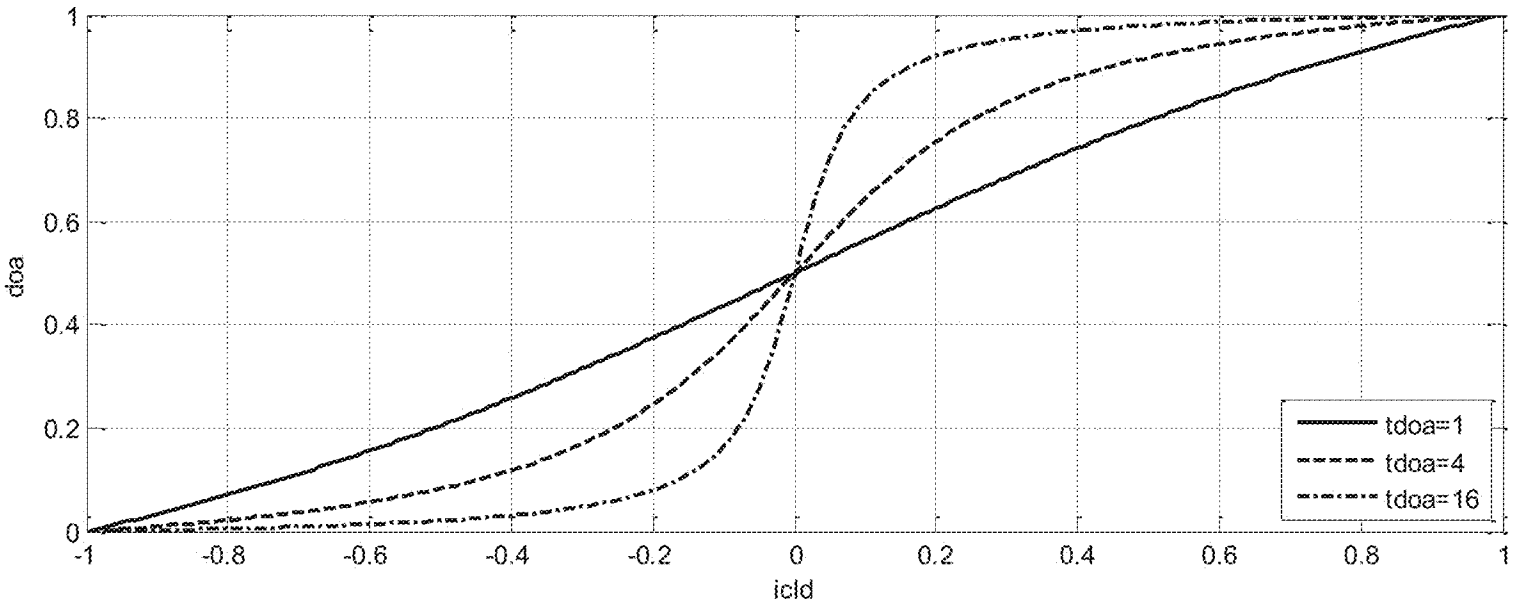
FIG. 5 shows a post-processing function for DOA estimation from the first and second ICLD.

In the specific time-frequency tile (k,i), a DOA information doa(k,i)=1 corresponds to sound coming from the front direction of the microphone arrangement 100, and a DOA information doa(k,i)=0 corresponds to sound coming from the back direction of the microphone arrangement 100. Intermediate values lead to DOA information representing sound coming from certain angles to the microphone arrangement 100, which can be derived as (1−doa(k,i))π. Thereby, tdoa denotes a parameter controlling the front-back separation strength shown in FIG. 5. The larger the parameter tdoa is, the more the front-back separation will be emphasized in the steering signal (DOA, 1-DOA).

Generally, the processor 105 is preferably configured to use the first ICLD to determine the DOA information for frequencies of the steering signal (DOA, 1-DOA) at or below a determined threshold value, and to use the second ICLD to determine the DOA information for frequencies of the steering signal (DOA, 1-DOA) above the determined threshold value.

Figure 6:
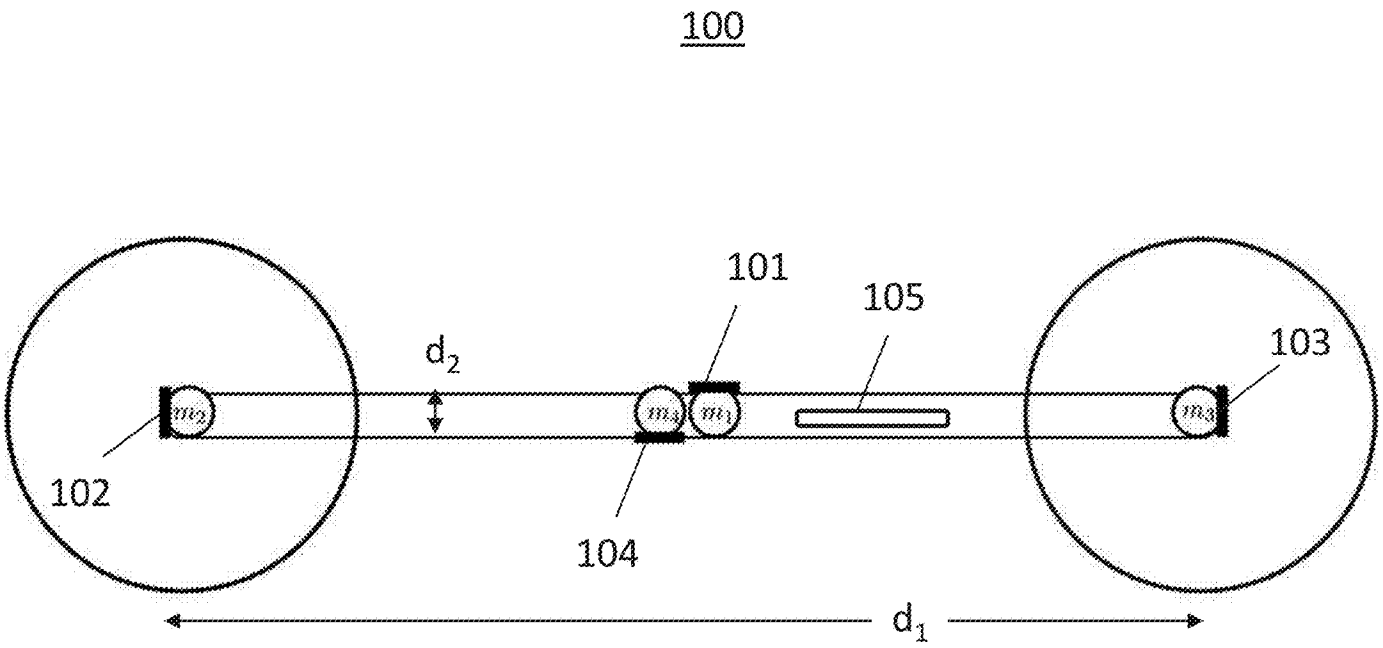
FIG. 6 shows a top view of the mobile device of FIG. 1, wherein the microphones for obtaining the stereo signal are remotely placed to capture an enlarged stereo image.

While the microphones 101 and 104 are dedicated to obtain the steering signal (DOA, 1-DOA) (i.e. are the FB pair for determining front-back separation), the two other microphones 102 and 103, as illustrated in FIG. 6, directly yield a stereo image as the stereo signal. As the distance $d_1$ between these two microphones 102 and 103 is typically large when placed at opposite sides of a mobile device 200 (usually above 100 mm), the omnidirectional to stereo processing (as proposed in C. Faller, "Conversion of two closely spaced omnidirectional microphone signals to an xy stereo signal", Preprint 129th Conv. Aud. Eng. Soc., November 2010) does not apply without too strong limitations, mainly aliasing starting already at a very low frequency. However, the rather large distance $d_1$ and the opposite placement of the microphones are suited to directly yield an enlarged stereo image as the stereo signal.

Figure 7:
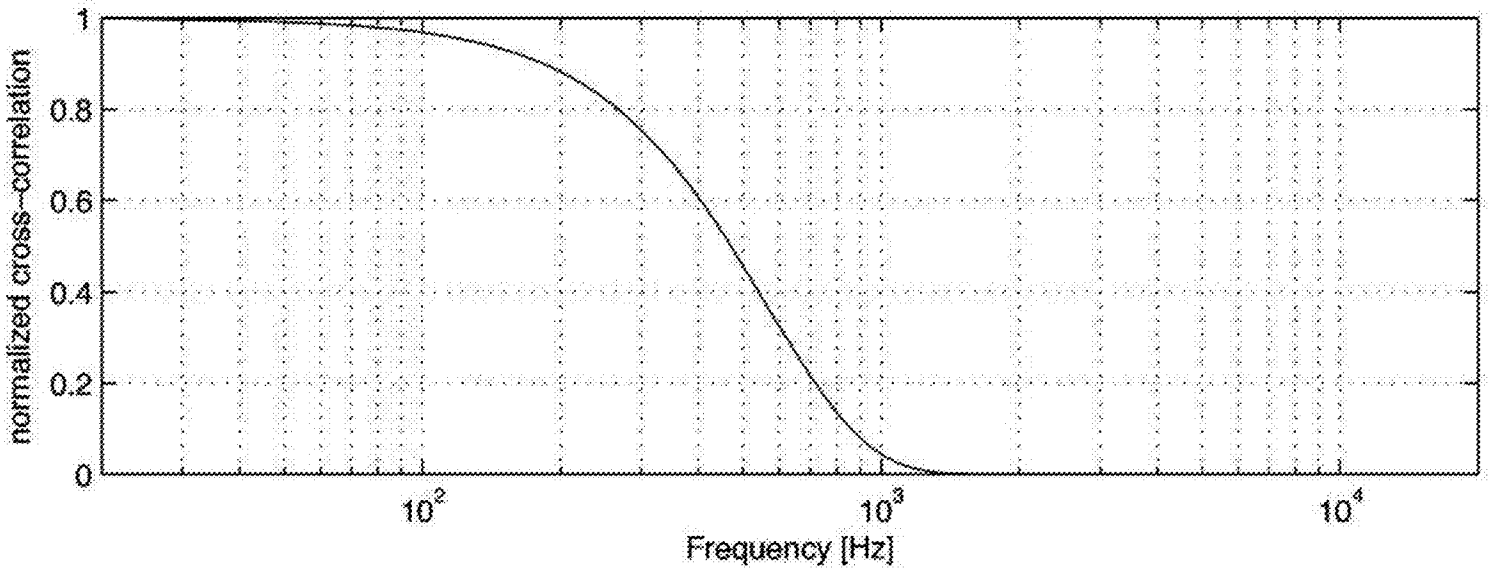
FIG. 7 shows a frequency dependence of a normalized cross-correlation.

Based on this naturally captured stereo signal, the surround multichannel generation is helped by direct-sound and diffuse-sound component extraction in both the left and right channels, i.e. the channels captured by the microphones 102 and 103, respectively. Analogously to the diffuse-sound extraction used for the virtual cardioids (described by C. Tournery et al., "Converting stereo microphone signals directly to mpeg-surround", Preprint 128th Conv. Aud. Eng. Soc., 5 2010), here the diffuse-sound component is estimated based on the two omnidirectional power spectra M2(k,i) and M3(k,i). Rather than considering a constant normalized cross-correlation θdiff over all frequencies, a Gaussian model is preferably derived approximating the curves (as proposed in R. K. Cook et al., "Measurement of correlation coefficients in reverberant sound fields", Journal of the Acoustical Society of America, 27(6):1072-1077, 1955) as shown in FIG. 7:

$$\theta_{diff}(i) = \exp\left(-\frac{i^2}{2i_c^2}\right), \tag{10}$$

In formula (10) $i_c$ is the index of the Gaussian frequency model. The resulting diffuse power spectrum is $P_{diff}$, and two Wiener gain filters to retrieve the direct left and right sounds are, respectively:

$$W_2(k, i) = \sqrt{\frac{M_2(k, i) - P_{diff}(k, i)}{M_2(k, i)}} \tag{11}$$

$$W_3(k, i) = \sqrt{\frac{M_3(k, i) - P_{diff}(k, i)}{M_3(k, i)}},$$

Analogously, the diffuse-sound components in both left and right channels are retrieved from the filters as:

$$V_2(k, i) = \sqrt{\frac{P_{diff}(k, i)}{M_2(k, i)}} \tag{12}$$

$$V_3(k, i) = \sqrt{\frac{P_{diff}(k, i)}{M_3(k, i)}}$$

The gains in the formulas (11) and (12) are preferably limited using a maximum allowed attenuation gdiff. Eventually, four output signals are derived serving as basis for the generation of the surround multichannel signals. First of all the direct-sound component from the left:

$$X_{l,dir}(k,i)=W_2(k,i)M_2(k,i). \tag{13}$$

Then the direct-sound component from the right:

$$X_{r,dir}(k,i)=W_3(k,i)M_3(k,i). \tag{14}$$

And the diffuse-sound components from the left and right, respectively:

$$X_{l,diff}(k,i)=V_2(k,i)M_2(k,i) \tag{15}$$

$$X_{r,diff}(k,i)==V_3(k,i)M_3(k,i), \tag{16}$$

These four generated signals (13-16) are combined with the help of the DOA information of the formula (9) into multichannel output signals. As a first step the target generated output format is a 5.1 standard surround signal including successively front left (FL), front right (FR), center (C), low frequency effects (LFE), rear left (RL), and rear right (RR).

Thereby, FL is composed of the direct sound of the left channel coming from the front direction and the left diffuse sound, FR is composed of the direct sound of the right channel coming from the front direction and the right diffuse sound, RL is composed of the direct sound of the left channel coming from the back direction and the left diffuse sound low-pass filtered, and RR is composed of the direct sound of the right channel coming from the back direction and the right diffuse sound low-pass filtered.

Optionally, the diffuse signals can be low-pass-filtered before adding them to the surround channels BL and BR. Low-pass-filtering these signals has the beneficial effect of simulating a room response, thus creating the perception of reflections from a virtual listening room.

Figure 8:
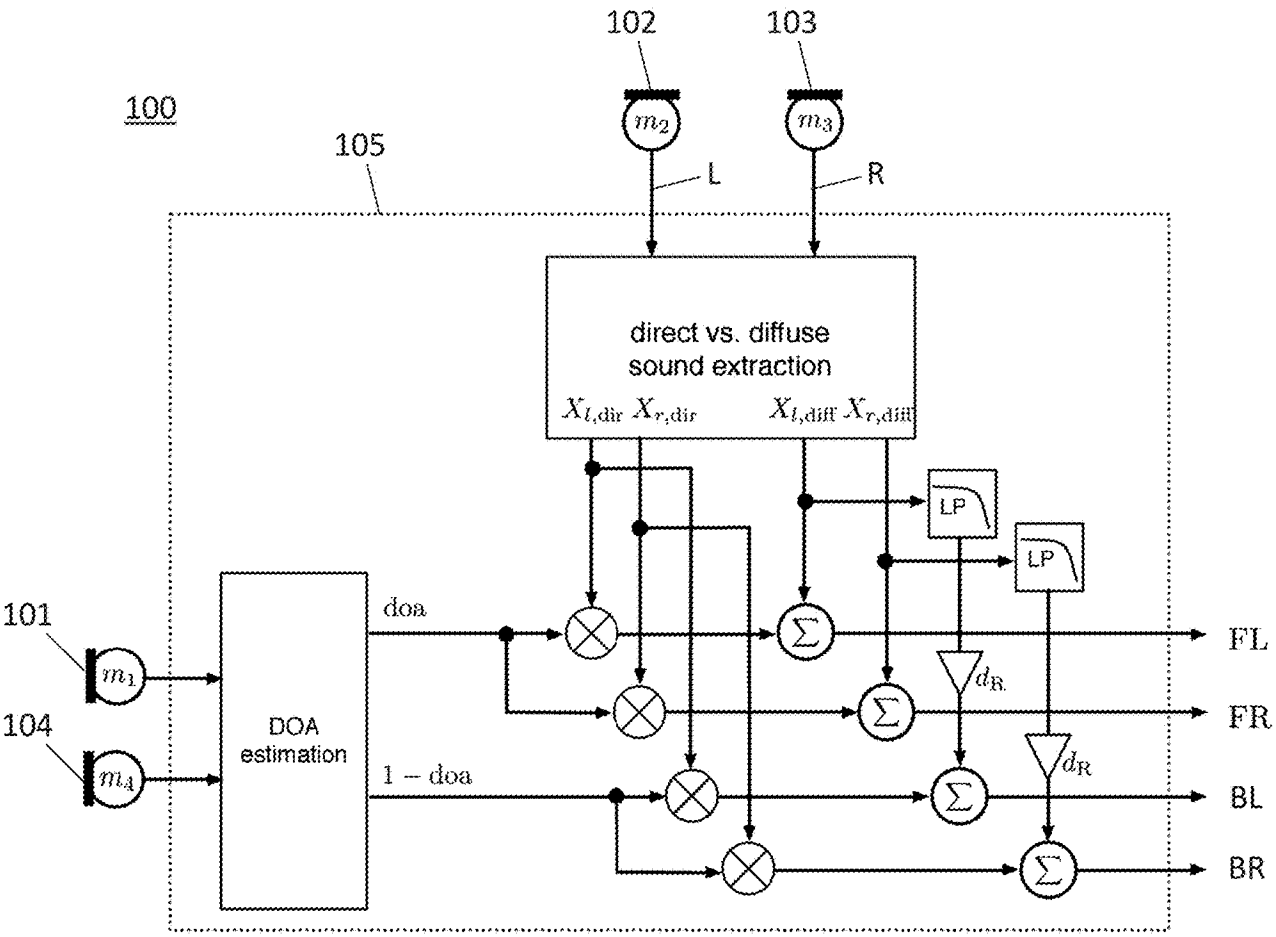
FIG. 8 shows a block diagram of a multichannel signal generation unit based on a front-back separation obtained from the steering signal, and based on direct-sound and diffuse-sound components extracted from the stereo signal.

The generation of these four output channels by the processor 105 is summarized in the block diagram in FIG. 8. Given an optional low-pass filter with a frequency response GLP(k,i), and a possible time delay $d_R$, the four pre-defined output channels are obtained by:

$$X_{FL}(k,i)=doa(k,i)X_{l,dir}(k,i)+X_{l,diff}(k,i) \quad (17)$$

$$X_{FR}(k,i)=doa(k,i)X_{r,dir}(k,i)+X_{r,diff}(k,i) \quad (18)$$

$$X_{BL}(k,i)=(1-doa(k,i))X_{r,dir}(k,i)+G_{LP}(k,i)X_{r,diff}(k-d_R,i) \quad (19)$$

$$X_{BR}(k,i)=(1-doa(k,i))X_{r,dir}(k,i)+G_{LP}(k,i)X_{r,diff}(k-d_R,i) \quad (20)$$

Optionally, a center channel is obtained either from left/right channel mixing of the stereo signal obtained by the microphones 102 and 103, or by directly using the fourth microphone 104 (in this case this microphone should be high-grade as the microphones 102 and 103).

Figure 9:
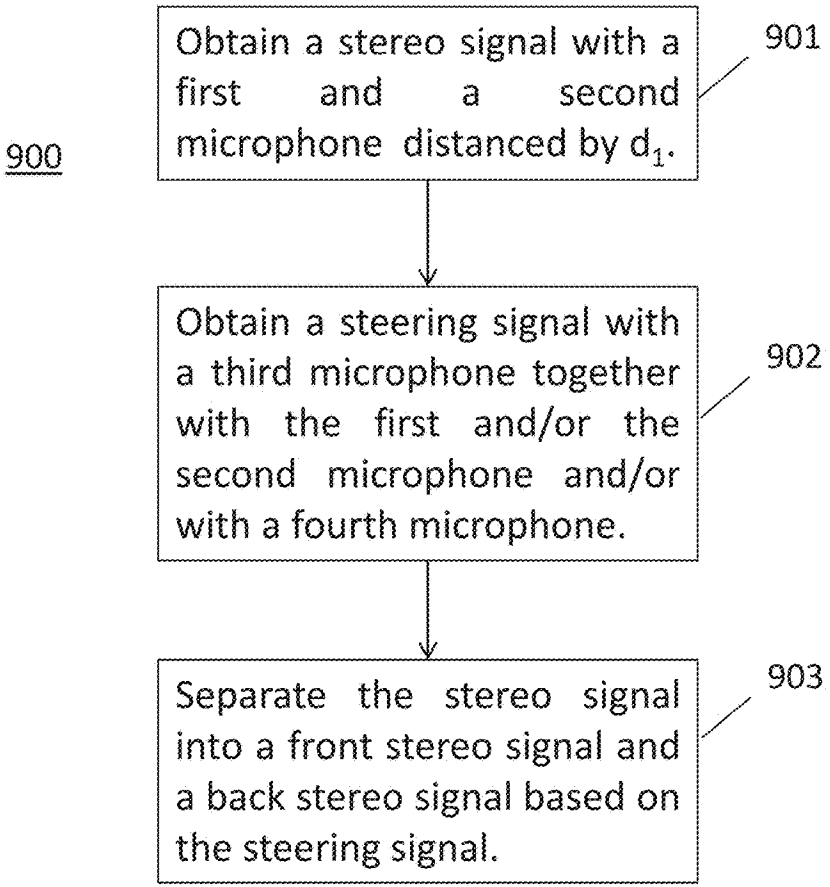
FIG. 9 shows a flowchart diagram of method steps of a method according to an embodiment of the present disclosure.

In FIG. 9 a method 900 of surround sound recording in a mobile device is shown. In a first step 901 of the method 900, a stereo signal is obtained with the first microphone and the second microphone. The microphones are distanced from each other by the first distance dr. In a second step 902 a steering signal is obtained with the third microphone, either together with the fourth microphone, or together with one or both of the first and second microphones. In a third step 903 of the method 900, the stereo signal is separated into a front stereo signal and a back stereo signal based on the steering signal. The separation is preferably performed by the processor, but can also be performed by one of the microphones or by the mobile device.

In summary, the present disclosure provides a microphone arrangement and method to record surround sound using mobile devices by employing cheap omnidirectional microphones. The present disclosure is fully stereo (left/right) backward compatible. The left/right separation in the stereo signal obtained by the LR pair microphones is wide enough, even when using omnidirectional microphones thanks to the typical sizes of mobile devices. The back (optionally front) microphones of the FB pair are only used for extraction of the DOA information of the sound, and thus can be chosen to be of lower-grade, and do not need to be calibrated. The present disclosure avoids front-back confusion (i.e. a lack of front/back information), which exists in the conventional recording of stereo signals.

The present disclosure has been described in conjunction with various embodiments as examples as well as implementations. However, other variations can be understood and effected by those persons skilled in the art and practicing the claimed disclosure, from the studies of the drawings, this disclosure and the independent claims. In the claims as well as in the description the word "comprising" does not exclude other elements or steps and the indefinite article "a" or "an" does not exclude a plurality. A single element or other unit may fulfill the functions of several entities or items recited in the claims. The mere fact that certain measures are recited in the mutual different dependent claims does not indicate that a combination of these measures cannot be used in an advantageous implementation.

What is claimed is:

1. A microphone arrangement for recording surround sound in a mobile device, comprising:

a first microphone arranged to obtain a first audio signal of a stereo signal;

a second microphone arranged to obtain a second audio signal of the stereo signal;

a third microphone configured to obtain a third audio signal, the third microphone comprising an omnidirectional sound pressure microphone; and a processor coupled to the first microphone, the second microphone, and the third microphone and configured to:

obtain a steering signal based on the third audio signal and another audio signal obtained by another microphone of the microphone arrangement, the steering signal comprising direction-of-arrival (DOA) information, and the another microphone comprising another omnidirectional sound pressure microphone;

separate the stereo signal into a front stereo signal and a back stereo signal based on the steering signal;

combine the DOA information with at least a part of the stereo signal to obtain the front stereo signal and the back stereo signal;

determine the DOA information based on a first inter-channel-level-difference (ICLD) between the third audio signal and the another audio signal, the first ICLD based on a difference between time or frequency representations in particular power spectra of the third audio signal and the another audio signal;

process the third audio signal and the another audio signal such that two virtual sound pressure gradient microphones directed to opposite directions are formed; and obtain the first ICLD on a basis of output signals of the two virtual sound pressure gradient microphones.

2. The microphone arrangement of claim 1, wherein the microphone arrangement comprises a fourth microphone arranged to obtain a fourth audio signal, and the processor is further configured to obtain the steering signal based on the third audio signal and at least one of the first audio signal, the second audio signal, and the fourth audio signal.

3. The microphone arrangement of claim 1, wherein the processor is further configured to:

determine a direct-sound component and a diffuse-sound component of the stereo signal; and combine the DOA information only with the direct-sound component of the stereo signal to obtain the front stereo signal and the back stereo signal.

4. The microphone arrangement of claim 1, wherein the processor is further configured to determine the DOA information additionally based on a second ICLD between the third audio signal and the another audio signal, the second ICLD based on a difference between time or frequency representations in particular power spectra between the third audio signal and the another audio signal, and the difference being caused by a shadowing effect of a housing of the microphone arrangement disposed at least partly between the third microphone and the another microphone.

5. The microphone arrangement of claim 4, wherein the processor is further configured to:

set the first ICLD to determine the DOA information for frequencies of the stereo signal at or below a determined frequency threshold value; and set the second ICLD to determine the DOA information for frequencies of the stereo signal above the determined frequency threshold value.

6. The microphone arrangement of claim 5, wherein the determined frequency threshold value depends on a second distance between the third microphone and one of the first, second, and a fourth microphone.

7. The microphone arrangement of claim 1, wherein the processor is further configured to bias the first ICLD or a second ICLD towards the third microphone or the another microphone.

8. The microphone arrangement of claim 1, wherein the processor is further configured to bias the DOA information towards one of the third microphone or the another microphone.

9. The microphone arrangement of claim 1, wherein the third microphone and the another microphone are directional microphones and are directed to opposite directions, or the first microphone and the second microphone are directional microphones and are directed towards the opposite directions.

10. The microphone arrangement of claim 1, wherein the processor is further configured to determine a center signal from the stereo signal.

11. The microphone arrangement of claim 1, wherein a fourth microphone of the microphone arrangement is configured to obtain a center signal.

12. A method of surround sound recording in a mobile device, comprising:

obtaining a first audio signal of a stereo signal with a first microphone;

obtaining a second audio signal of the stereo signal with a second microphone;

obtaining a third audio signal with a third microphone, the third microphone comprising an omnidirectional sound pressure microphone;

obtaining a steering signal based on either the third audio signal and the first audio signal or the second audio signal or based on a fourth audio signal obtained by a fourth microphone, the steering signal comprising direction-of-arrival (DOA) information;

separating the stereo signal into a front stereo signal and a back stereo signal based on the steering signal;

combining the DOA information with at least a part of the stereo signal to obtain the front stereo signal and the back stereo signal;

determine the DOA information based on a first inter-channel-level-difference (ICLD) between the third audio signal and another audio signal of another microphone, the another microphone comprising another omnidirectional sound pressure microphone, and the first ICLD based on a difference between time or frequency representations in particular power spectra of the third audio signal and the another audio signal;

process the third audio signal and the another audio signal such that two virtual sound pressure gradient microphones directed to opposite directions are formed; and obtain the first ICLD on a basis of output signals of the two virtual sound pressure gradient microphones.

13. A mobile device for recording surround sound, comprising:

a non-transitory memory comprising instructions; and one or more processors in communication with the memory, the one or more processors executing the instructions to perform a method comprising the following operations:

obtaining a first audio signal of a stereo signal with a first microphone;

obtaining a second audio signal of the stereo signal with a second microphone;

obtaining a third audio signal with a third microphone, the third microphone comprising an omnidirectional sound pressure microphone;

obtaining a fourth audio signal with a fourth microphone;

obtaining a steering signal based on the third audio signal and one of the first audio signal, the second audio signal, or the fourth audio signal, the steering signal comprising direction-of-arrival (DOA) information;

separating the stereo signal into a front stereo signal and a back stereo signal based on the steering signal;

combining the DOA information with at least a part of the stereo signal to obtain the front stereo signal and the back stereo signal;

determining the DOA information based on a first inter-channel-level-difference (ICLD) between the third audio signal and another audio signal of another microphone, the another microphone comprising another omnidirectional sound pressure microphone, and the first ICLD based on a difference between time or frequency representations in particular power spectra of the third audio signal and the another audio signal;

processing the third audio signal and the another audio signal such that two virtual sound pressure gradient microphones directed to opposite directions are formed; and obtaining the first ICLD on a basis of output signals of the two virtual sound pressure gradient microphones.

* * * * *